US005283587A

United States Patent [19]

Hirshfield et al.

[11] Patent Number: 5,283,587

[45] Date of Patent: Feb. 1, 1994

[54] ACTIVE TRANSMIT PHASED ARRAY ANTENNA

[75] Inventors: Edward Hirshfield, Cupertino; Edgar W. Matthews, Jr., Mountain View; Howard H. Luh, Sunnyvale, all of Calif.

[73] Assignee: Space Systems/Loral, Palo Alto, Calif.

[21] Appl. No.: 983,123

[22] Filed: Nov. 30, 1992

[51] Int. Cl.[5] ..... H01Q 3/22; H01Q 3/24; H01Q 3/26

[52] U.S. Cl. ..... 342/372; 342/373; 342/361

[58] Field of Search ..... 342/372, 373, 361

[56] References Cited

U.S. PATENT DOCUMENTS 4,901,369 2/1990 Momose et al. ..... 342/361
5,162,803 11/1992 Chen ..... 342/372

*Primary Examiner*—Theodore M. Blum
*Attorney, Agent, or Firm*—Perman & Green

[57] ABSTRACT

An active transmit phased array antenna system for generating multiple independent simultaneous antenna beams to illuminate desired regions while not illuminating other regions. The size shape of the regions is a function of the size and number of elements populating the array and the number of beams is a function of the number of beam forming networks feeding the array. All the elements of the array are operated at the same amplitude level and beam shapes and directions are determined by the phase settings. The active transmit phased array antenna includes a plurality of antenna elements disposed in a hexiform configuration. Each antenna element is identical and includes a radiating horn capable of radiating in each of two orthogonal polarizations. The horn is fed by a multi-pole bandpass filter means whose function is to pass energy in the desired band and reject energy at other frequencies. The filter means is coupled into an air dielectric cavity mounted on substrate. The air dielectric cavity contains highly efficient monolithic amplifiers which excite orthogonal microwave energy in a push-pull configuration by probes in combination with amplifiers placed such that they drive the cavity at relative positions 180 degrees apart. Phase shift means and attenuator means in the substrate are connected to the amplifiers in the cavity to determine beam and direction and for maintaining the signal amplitudes from each of the antenna elements at an equal level.

8 Claims, 2 Drawing Sheets

ACTIVE TRANSMIT PHASED ARRAY ANTENNA

FIELD OF THE INVENTION

The present invention relates to microwave beam antenna systems and more particularly to phased array antenna systems of the type which generate multiple simultaneous antenna beams by controlling the relative phase of signals in multiple radiating elements.

BACKGROUND OF THE INVENTION

For many years radar system array antennas have been known, and have been used for the formation of sharply directive beams. Array antenna characteristics are determined by the geometric position of the radiator elements and the amplitude and phase of their individual excitations.

Later radar developments, such as the magnetron and other high powered microwave transmitters, had the effect of pushing the commonly used radar frequencies upward. At those higher frequencies, simpler antennas became practical which usually included shaped (parabolic) reflectors illuminated by horn feed or other simple primary antenna.

Next, electronic (inertialess) scanning became important for a number of reasons, including scanning speed and the capability for random or programmed beam pointing. Since the development of electronically controlled phase shifters and switches, attention has been redirected toward the array type antenna in which each radiating element can be individually electronically controlled. Controllable phase shifting devices in the phased array art provides the capability for rapidly and accurately switching beams and thus permits a radar to perform multiple functions interlaced in time, or even simultaneously. An electronically steered array radar may track a great multiplicity of targets, illuminate a number of targets for the purpose of guiding missiles toward them, perform wide-angle search with automatic target selection to enable selected target tracking and may act as a communication system directing high gain beams toward distant receivers and/or transmitters. Accordingly, the importance of the phase scanned array is very great. The text "Radar Handbook" by Merrill I. Skolnik, McGraw Hill (1970) provides a relatively current general background in respect to the subject of array antennas in general.

Other references which provide general background in the art include:

U.S. Pat. No. 2,967,301 issued Jan. 3, 1961 to Rearwin entitled, SELECTIVE DIRECTIONAL SLOTTED WAVEGUIDE ANTENNA describes a method for creating sequential beams for determining aircraft velocity relative to ground.

U.S. Pat. No. 3,423,756 issued Jan. 21, 1969, to Folder, entitled SCANNING ANTENNA FEED describes a system wherein an electronically controlled conical scanning antenna feed is provided by an oversized waveguide having four tuned cavities mounted about the waveguide and coupled to it. The signal of the frequency to which these cavities are tuned is split into higher order modes thus resulting in the movement of the radiation phase center from the center of the antenna aperture. By tuning the four cavities in sequence to the frequency of this signal, it is conically scanned. Signals at other frequencies if sufficiently separated from the frequency to which the cavities are tuned continue to propagate through the waveguide without any disturbance within the waveguide.

U.S. Pat. No. 3,969,729, issued Jul. 13, 1976 to Nemet, entitled NETWORK-FED PHASED ARRAY ANTENNA SYSTEM WITH, INTRINSIC RF PHASE SHIFT CAPABILITY discloses an integral element/-phase shifter for use in a phase scanned array. A non-resonant waveguide or stripline type transmission line series force feeds the elements of an array. Four RF diodes are arranged in connection within the slots of a symmetrical slot pattern in the outer conductive wall of the transmission line to vary the coupling therefrom through the slots to the aperture of each individual antenna element. Each diode thus controls the contribution of energy from each of the slots, at a corresponding phase, to the individual element aperture and thus determines the net phase of the said aperture.

U.S. Pat. No. 4,041,501 issued, Aug. 9, 1977 to Frazeta et al., entitled LIMITED SCAN ARRAY ANTENNA SYSTEMS WITH SHARP CUTOFF OF ELEMENT PATTERN discloses array antenna systems wherein the effective element pattern is modified by means of coupling circuits to closely conform to the ideal element pattern required for radiating the antenna beam within a selected angular region of space. Use of the coupling circuits in the embodiment of a scanning beam antenna significantly reduces the number of phase shifters required.

U.S. Pat. No. 4,099,181, issued Jul. 4, 1978, to Scillieri et al, entitled FLAT RADAR ANTENNA discloses a flat radar antenna for radar apparatus comprising a plurality of aligned radiating elements disposed in parallel rows, in which the quantity of energy flowing between each one of said elements and the radar apparatus can be adjusted, characterized in that said radiating elements are waveguides with coplanar radiating faces, said waveguides being grouped according to four quadrants, each one of said quadrants being connected with the radar apparatus by means of a feed device adapted to take on one or two conditions, one in which it feeds all the waveguides in the quadrant and the other in which it feeds only the rows nearest to the center of the antenna excluding the other waveguides in the quadrant, means being provided for the four feed devices to take on at the same time the same condition, so that the radar antenna emits a radar beam which is symmetrical relatively to the center of the antenna, and having a different configuration according to the condition of the feed devices.

U.S. Pat. No. 4,595,926, issued Jun. 17, 1986 to Kobus et al. entitled DUAL SPACE FED PARALLEL PLATE LENS ANTENNA BEAMFORMING SYSTEM describes a beamforming system for a linear phased array antenna system which can be used in a monpulse transceiver, comprising a pair of series connected parallel plate constrained unfocused lenses which provide a suitable amplitude taper for the linear array to yield a low sidelobe radiation pattern. Digital phase shifters are used for beam steering purposes and the unfocused lenses decorrelate the quantization errors caused by the use of such phase shifters.

U.S. Pat. No. 3,546,699, issued Dec. 8, 1970 to Smith, entitled SCANNING ANTENNA SYSTEM discloses a scanning antenna system comprising a fixed array of separate sources of in-phase electromagnetic energy arranged in the arc of a circle, a transducer having an arcuate input contour matching and adjacent to the arc, a linear output contour, and transmission properties such that all of the output energy radiated by the reansducer is in phase, and means for rotating the transducer in the plane of the circle about the center of the circle.

SUMMARY OF THE INVENTION

A phased array antenna system, more particularly, an active transmit phased array antenna for generating multiple independent simultaneous antenna beams to illuminate desired regions while not illuminating other regions. The size and shape of the regions is a function of the size and number of elements populating the array and the number of beams is a function of the number of beam forming networks feeding the array. All the elements of the array are operated at the same amplitude level and beam shapes and directions are determined by the phase settings.

BRIEF DESCRIPTION OF THE DRAWINGS

Referring to FIG. 1, a version of an active transmit phased array antenna is shown including an illustrative number of the 213 elements disposed in a hexiform configuration. FIG. 2 illustrates a single one of the 213 elements included in the antenna of FIG. 1. Each element of FIG. 1 is identical to that shown in FIG. 2 and includes a radiating horn 10 capable of radiating in each of two orthogonal polarizations with isolation of 25 dB or greater. The horn is fed by a multi-pole bandpass filter means 12 whose function is to pass energy in the desired band and reject energy at other frequencies. This is of particular importance when the transmit antenna of the present invention is employed as part of a communication satellite that also employs receiving antenna(s) because spurious energy from the transmitter in the receive band could otherwise saturate and interfere with the sensitive receiving elements in the receiving antenna(s) In the present embodiment the filter means 12 is comprised of a series of sequential resonant cavities, coupled to one another in a way which maintains the high degree of orthogonality necessary to maintain the isolation referred to above.

The filter means 12 is coupled into an air dielectric cavity 14 mounted on substrate 36. Air dielectric cavity 14 contains highly efficient monolithic amplifiers which excite orthogonal microwave energy in a push-pull configuration. Referring to FIG. 3, which is a schematic plan view of the air dielectric cavity 14 of FIG. 2, this excitation is accomplished by probes 18, 20, 30 and 32 in combination with amplifiers 22, 24, 26 and 28. In FIG. 3, the probes 18 and 20 are placed such that they drive the cavity 14 at relative positions 180° apart. This provides the transformation necessary to afford the push pull function when amplifiers 22 and 24 are driven out-of-phase. Amplifiers 26 and 28 similarly feed probes 30 and 32 which are 180° apart and are positioned at 900 from probes 18 and 20 so that they may excite orthogonal microwave energy in the cavity. The two pairs of amplifiers are fed in phase quadrature by hybrid input 34 via 180 degree couplers 34A and 34B to create circular polarization.

In order to accomplish the exact phase and amplitude uniformity necessary for orthogonal beams, amplifiers 22, 24, 26, and 28 must be virtually identical. The only practical way to enable this identity is to employ monolithic microwave integrated circuits (MMIC's) for the amplifiers.

Figure 1:
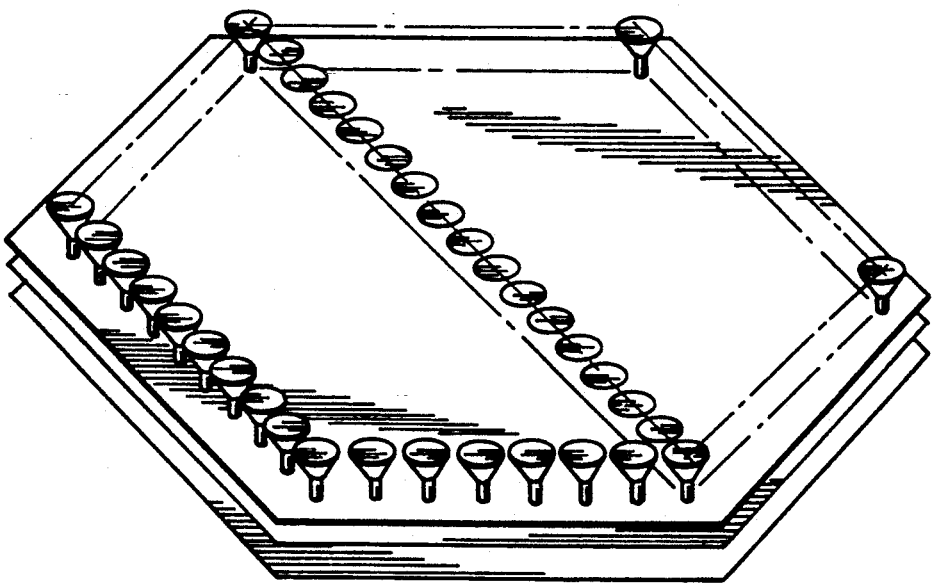
FIG. 1 is an illustration of a plurality of arrayed elements for an active transmit phased array antenna.
Figure 2:
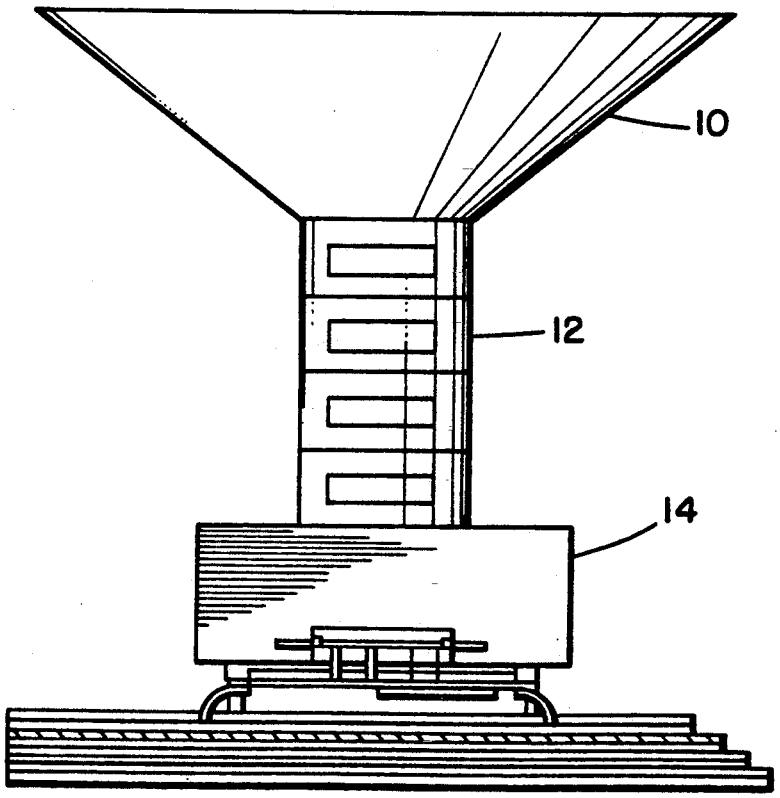
FIG. 2 is a schematic illustration of a cross-section of an element of the plurality of the type employed in the multi-element phased array antenna of FIG. 1.
Figure 3:
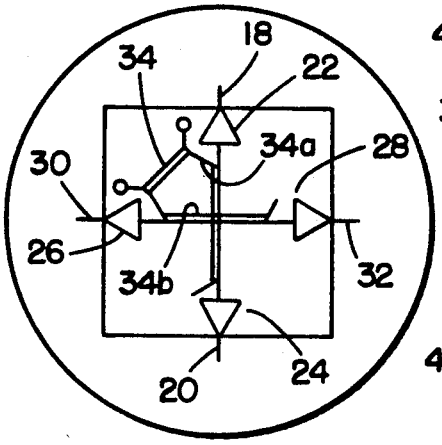
FIG. 3 is a schematic top view of the air dielectric cavity shown in FIG. 2.
Figure 4:
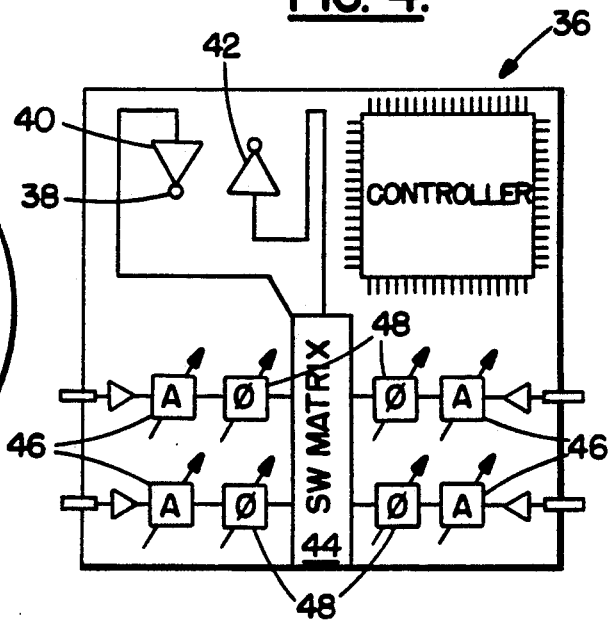
FIG. 4 is a schematic bottom view of the controller used in the system of FIG. 2.

The 90° hybrid 34 is shown terminating in two dots in FIG. 3. These dots represent feed thru connections from the substrate 36 illustrated in the bottom view of FIG. 4, and the other ends of the feed thru connections can be seen at location 38 and 39. One of these excites right circular polarization while the other excites left circular polarization. Additionally, if the signals passing through the feed thru connections were fed directly to 180° couplers 34A and 34B without the benefit of the 90° hybrid 34, linearly polarized beams rather than circularly polarized beams would be excited. The hybrid 34 is fed through connectors 38 and 39 by MMIC driver amplifiers 40 and 42, one for each sense of polarization. The desired polarization for each beam is selected by switch matrix 44, which also combines all the signals for each polarization to feed the two driver amplifiers 40 and 42. Each beam input (in the present example four) includes an electronically controlled phase shifter 48 and attenuator 46 used to establish the beam direction and shape (size of each beam). All elements in the array are driven at the same level for any given beam. This is different from other transmit phased arrays, which use amplitude gradients across the array to reduce beam sidelobes.

The active transmit phased array antenna being disclosed herein employs uniform illumination (no gradient) in order to maximize the power efficiency of the antenna. Otherwise, the power capacity of an antenna element is not fully utilized. The total available power can be arbitrarily distributed among the set of beams with no loss of power. Once the power allocation for a given beam has been set on all elements of the antenna by setting the attenuators 46, then the phase (which is most likely different for every element) is set employing phase shifters 48 to establish the beam directions and shapes. The phase settings for a desired beam shape and direction are chosen by a process to synthesize the beam. The synthesis process is an iterative, computation-intensive procedure, which can be stored in a computer. The objective of the synthesis process is to form a beam which most efficiently illuminates the desired region without illuminating the undesired regions. The region could be described by a regular polygon and the minimum size of any side will be set by a selected number of elements in the array and their spacing. In general, the more elements in the array the more complex the shape of the polygon that may be synthesized. The process of phase-only beam shaping generates the desired beam shape but also generates grating lobes. Another objective of this invention, as used for a satellite antenna, is to minimize the relative magnitude of the grating lobes and to prevent them from appearing on the surface of the earth as seen from the satellite orbital position so that they will not appear as interference in an adjacent beam or waste power by transmitting it to an undesired location. The synthesis process minimizes the grating lobes, and it may also be used to generate a beam null at the location of a grating lobe that cannot otherwise be minimized to an acceptable level.

Figure 5:
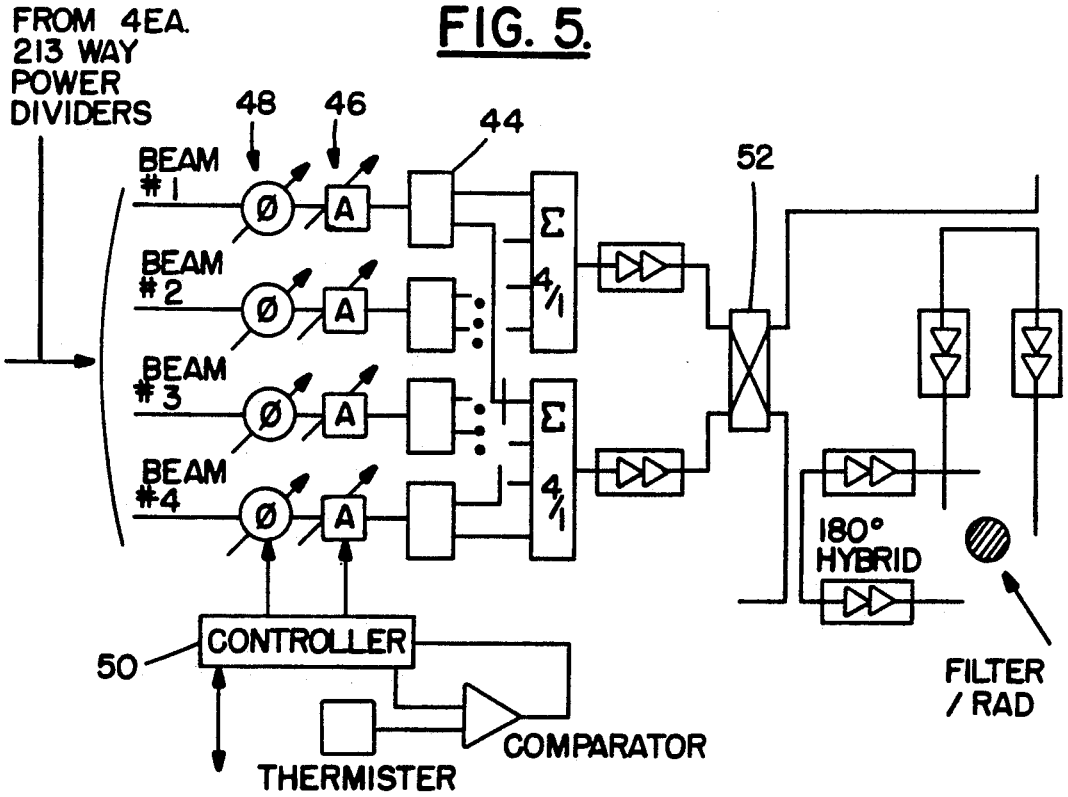
FIG. 5 is a schematic illustration showing phase shifters and attenuators of FIG. 4 in more detail and with their associated circuits.

The number of independent beams that can be generated by the active transmit phase array antenna is limited only by the number of phase shifters 48 and attenuators 46 feeding each element. Referring to FIG. 5, it is indicated that each string of phase shifters 48 and attenuators 46 is fed by a different uniform power divider. The number of ports on each power divider must be equal to or greater than the number of elements. In the example shown in FIG. 5, the number of ports on the power divider must be 213 or greater. The number of power dividers must equal to the number of independent beams that the antenna can generate. The systems of example shown would thus require four power dividers each having 213 parts.

As stated previously, the sum of the power in each of the beams must equal the capacity of all of the elements in order to maximize efficiency. The capacity of each element is understood to be the linear or non-distorting capacity. In order for the active transmit phased array antenna to preserve the independence of the several beams it generates, each of the amplifiers in the chain must operate in its linear range in order to prevent an unacceptable degree of crosstalk between the beams. As long as the amplifiers are linear, then the principle of linear superposition is valid. When the amplifiers are driven into their non-linear region, the independence of the beams is jeopardized. The final amplifiers 22, 24, 26 and 28 are most critical because they consume more than 90% of the power. In order to provide acceptable performance, they must exhibit on the order of 0.1% total harmonic distortion at all operating levels below the specified maximum.

Control for each element is embodied in a microprocessor controller 50 shown in FIG. 5, together with interface electronics incorporated within a large scale gate array. The controller 50 not only has the capability of generating the specific control voltages required by each phase shifter and attenuator, but it can also store the present and next command set. With this control mechanization in place beams may be switched either on an as required-basis, or on a time division multiplexed basis to serve a large quantity of independent regions. The controllers for each element are interconnected by means of a typical inter-device control bus. When the antenna is used as part of a communication satellite, an interdevice control bus also is used to connect to a master controller co-located with the satellite control electronics. A typical set of coefficients for each beam will be computed on the ground and relayed to the satellite by way of the satellite control link. Each element has a unique bus address, established by hard wired code built into the combining network to which the element hardware is attached. Because of the potential of temperature related drift a thermistor may be used to compensate control voltages if required. If the voltages needed to control phase and amplitude are not linear, the microprocessors can store look up tables to allow linearization.

While the invention has been particularly shown and described with respect to a preferred embodiment thereof, it will be understood by those skilled in the art that changes in form and details may be made therein without departing from the scope and spirit of the invention.

We claim:

1. A phased array transmitting antenna system for generating multiple independent simultaneous microwave signal beams comprising:

a plurality of antenna radiating elements disposed on an array on a substrate, each one of said elements including amplifier means and hybrid coupler disposed in a cavity on said substrate for providing orthogonal microwave energy signals having selected phases, filter means responsive to the microwave output signals of said cavity for passing signals within a selected frequency band;

a radiating horn responsive to said microwave signals passed by said filter means for transmitting said microwave signals as a beam having a direction and shape; and wherein each of said plurality of said antenna radiating elements transmit one of multiple, simultaneous microwave beams having the same power value and different phase values which determine the shape and transmitted direction of said beams.

2. A phased array transmitting antenna system according to claim 1 wherein said cavity includes a first pair of microwave probes disposed in said cavity 180 degrees apart, a second pair of probes disposed in said cavity 180 degrees apart, said first and second pairs of probes being disposed 90 degrees apart, a first pair of linear amplifiers connected to said first pair of probes and a second pair of linear amplifiers connected to said second pair of probes for exciting orthogonal microwave energy in said cavity.

3. A phased array transmitting antenna system according to claim 2 wherein said substrate includes phase shift means and attenuator means connected to said first and second pairs of amplifier and probes in said cavity for providing phase quadrature signals to create circular signal polarization wherein one of said pairs of amplifier and probes is excited to right circular polarization and the other of said pairs of amplifiers and probes is excited to left circular polarization.

4. A phased array transmitting antenna system according to claim 3 wherein said phase shift and attenuator means includes a plurality of separate phase shift and attenuator circuits, and a switch matrix connected to each of said phase shift and attenuator circuits to selectively connect separate polarization signals to said pairs of amplifiers and probes in said cavity, said separate polarization signals providing the direction and shape of said microwave beam transmitted from said horn.

5. A phased array transmitting antenna system according to claim 4 wherein said attenuator means are set to provide that said microwave beams transmitted from said horns of said plurality of elements are equal in amplitude.

6. A phased array transmitting antenna system according to claim 5 further including a plurality of power signals and wherein said phase shift and attenuator circuits for each antenna element includes a plurality of series connected phase shift and attenuator circuits, each of said plurality of series connected phase shift and attenuator circuits being connected to a separate power signal wherein each of said series connected phase shift and attenuator circuits is associated with a separate beam to be transmitted by said antenna element, and wherein each of said series connected phase shift and attenuator circuits establishes the direction and shape for each associated beam.

7. A phase array transmitting antenna system according to claim 6 further including control means connected to each of said phase shift circuits and attenuator circuits for setting said phase shift circuit for setting said phase shift circuits at selected values to provide desired beam directions and shapes, and for setting said attenuator circuit at selected values wherein all said antenna elements have the same amplitude level.

8. A phase array transmitting antenna system according to claim 7 further including a first and second monolithic microwave integrated circuit amplifiers connected between said hybrid coupler and said switch matrix, said monolithic microwave integrated circuit amplifier being highly linear to maintain said transmitted beams independent of each other to provide for multiple beams to be transmitted simultaneously without interaction.

* * * * *